US007528097B2

(12) United States Patent
Hanson et al.

(10) Patent No.: US 7,528,097 B2
(45) Date of Patent: May 5, 2009

(54) NON-EMULSION BASED OIL SIMULANT

(75) Inventors: Francis V. Hanson, Salt Lake City, UT (US); John V. Fletcher, Murray, UT (US); Alyssa M. Redding, Concord, CA (US); Christopher Olson, Tooele, UT (US); Jumpol Jaturapitpornsakul, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 583 days.

(21) Appl. No.: 11/198,006

(22) Filed: Aug. 4, 2005

(65) Prior Publication Data

US 2006/0027361 A1 Feb. 9, 2006

Related U.S. Application Data

(60) Provisional application No. 60/599,169, filed on Aug. 4, 2004.

(51) Int. Cl.
*C10M 169/04* (2006.01)

(52) U.S. Cl. ..... 508/491; 210/922; 210/923; 210/924; 210/925

(58) Field of Classification Search ..... 508/491, 508/136; 210/922–925
See application file for complete search history.

(56) References Cited

U.S. PATENT DOCUMENTS 4,100,082 A * 7/1978 Clason et al. ..... 508/412
5,196,129 A * 3/1993 Luisi ..... 508/112
5,801,131 A * 9/1998 Coffey et al. ..... 508/491
2002/0006519 A1* 1/2002 Anglin et al. ..... 428/457

OTHER PUBLICATIONS

Acaroglu, M. et al., "An Investigation of the Use of Rapeseed Oil in Agricultural Tractors as Engine Oil," Energy Sources, 2001, 23 (9), pp. 823-830.

Allen, A. et al, "Canola Oil as a Substitute for Crude Oil in Cold Water Spill Tests," Physical Behaviour, Jun. 14-16, 198, Section I, pp. 1-8.

United States Environmental Protection Agency, "Contingency Planning," See http://ww.epa.gov/oilspill/conting.htm (printed Feb. 1, 2006), p. 1.

EPA. 40 CFR Part 796 -Chemical Fate Testing Guidelines: Subpart D -Transformation Processes: 796.31 00 Aerobic Aquatic Biodegradation, http://www.access.gpo.gov/nara/cfr/waisidx01/40cfr79601.html, accessed 2002, United States Environmental Protection Agency, pp. 91-96.

(Continued)

*Primary Examiner*—Glenn A Caldarola
*Assistant Examiner*—Taiwo Oladapo
(74) *Attorney, Agent, or Firm*—Thorpe North & Western LLP

(57) ABSTRACT

A composition and method for a non-emulsion crude oil simulant containing biodegradable oil, and a terpene is disclosed and described. Biodegradable oils such as canola oil, cottonseed oil, and soybean oil can be particularly beneficial for use in connection with these oil simulants. Terpenes such as d-limonene can be included to provide oil simulant compositions which exhibit good oil simulant properties. Additives such as photochromic dyes, food dyes, food-grade antioxidants, microorganisms, and nutrients can also be used. These non-emulsion based oil simulants can be readily tailored and adjusted to approximate relevant properties of a specific target fluid for use in assessing oil spill response, containment, clean-up of equipment, percolation, and/or spill behavior.

22 Claims, 2 Drawing Sheets

OTHER PUBLICATIONS

PPG's Photosol® Photochromic Dyes, Frequently Asked Questions, See http://www.ppg.com/chm~optical/psol/fotofaqs.htm (accessed Jul. 2003), PPG Industries, Inc., pp. 1-2.

Goodman, R.H. et al., "Tracking Buoys for Oil Spills," In 1995 International Oil Spill Conference, Achieving and Maintaining Preparedness, Long Beach, CA, Feb. 7-Mar. 2, 1995/ See also American Petroleum Institute: Washington, D.C., 1995; pp. 1040.

Grierson, I.T., "Use of Airborne Thermal Imagery to Detect and Monitor Inshore Oil Spill Residues During Darkness Hours," Environ. Manage., 1998, 22 (6), pp. 905-912.

Merisol Antioxidants BHT Material Safety Data Sheet, Trade Name: BHT, Version date: Sep. 9, 2005, Version 1.0, pp. 1-8.

Newtec Our Product, Microbe-PLUS, See http://www.geocities.com/myorganizations/newtec/product.html (accessed Jul. 2003), Newtec: Bio-remediation, Sewer and Water Treatment, pp. 1-2.

Park, M. et al., "The Use of GPS Buoys to Calibrate Altimetric Satellites," In Proceedings of the 7th International Technical Meeting of The Satellite Division of the Institute of Navigation, Part 1, Salt Lake City, UT, Sep. 20-23, 1994. See also Inst. of Navigation, Alexandria, VA, 1994, vol. 1, pp. 221-230.

Plante, A.F.; Voroney, R.P., "Biodegradation and Bioremediation: Decomposition of Land Applied Oily Food Waste and Associated Changes in Soil Aggregate Stability," J. Environ. Qual. 1998, 27 (2), pp. 395-402.

Reed, M. et al, "Evaluation of Surface Drifters for Satellite Tracking of Oil on the Sea," Oceans, Sep. 1987, vol. 19, pp. 1611-1616.

Salvesen, J.; Stong, B.A.; Byers, D.G.; Smith, A.G.; Arnhart, R.; Gaudet, S.; Tomblin, T.G.; Teichman, K.M., "Establishing Optimal Response Strategies Using Real-Time Current Observations: A Local, Cooperative Approach," 1995 International Oil Spill Conference: Achieving and Maintaining Preparedness, Long Beach, CA, Feb. 27-Mar. 2, 1995, pp. 755-759. See also American Petroleum Institute, 1995.

Sraj, R. et al., "Rapidly Biodegradable Hydraulic Fluids on the Basis of Rapeseed Oil," Lubrication Engineering 2000, pp. 34-39.

Sigma-Aldrich MSDS, Brand: Supelco Inc., Product Name: Canola Oil, 1000 MG, NEAT, Version 1.0, Date Updated: Dec. 19, 2003, pp. 1-4.

Fisher Scientific MSDS d-Limonene, Purity 98% (gc), ACC#54537, MSDS Creation Date: Jan. 9, 1998, Revision #6 date: Nov. 17, 2004, MSDS Creation Date: Jan. 9, 2004, pp. 1-6.

* cited by examiner

NON-EMULSION BASED OIL SIMULANT

RELATED APPLICATIONS

This application claims the benefit of U.S. Provisional Patent Application No. 60/599,169, filed Aug. 4, 2004, which is incorporated herein by reference in its entirety.

FIELD OF THE INVENTION

The present invention relates generally to simulation of oil spills. More particularly, the present invention relates to biodegradable oil compositions which simulate crude and other oils for evaluation and testing. Accordingly, the present invention involves the fields of chemistry, petroleum engineering, environmental remediation, and environmental engineering.

BACKGROUND OF THE INVENTION

Well-designed oil spill contingency plans can not only facilitate oil spill response efforts, but also enhance those efforts by protecting sensitive habitats, circumventing unnecessary clean-up costs and minimizing danger to clean-up personnel. However, it is difficult to develop and/or optimize an effective contingency plan without using a crude oil or crude oil simulant as the test media. Similarly, the evaluation of oil spill response techniques, including personnel and equipment, requires the use of a fluid that behaves as a crude oil.

Several researchers have used a variety of materials to track crude oil movement to determine baseline response and equipment deployment strategies in accordance with local or facility contingency plans. Tracking buoy materials used include: cottonseed hulls, oranges and lemons, Styrofoam, plywood floats, marine fenders, tires and wood chips. Although these materials adequately track crude oil, their usefulness is limited to an existing oil spill. In addition, these materials do not adequately represent actual crude oil behavior. Other researchers have examined the use of canola oil as a crude oil simulant. However, canola oil is difficult to track and does not effectively represent crude oil behavior. Further, researchers have attempted to create computer models based on molecular dynamics (PVT models) and Monte Carlo simulations to approximate oil spill behavior. However, these models have limitations regarding computer speed and accurate representation of actual behavior. Therefore, improved materials and methods for simulating oil spills continues to be sought and would represent an advancement in the industry.

SUMMARY OF THE INVENTION

It has been recognized that it would be advantageous to develop materials and methods which accurately approximate actual oil spill behavior and which do not adversely impact the environment. In accordance with the present invention, a crude oil simulant can include a biodegradable oil and a terpene. The crude oil simulants of the present invention can have similar physical, chemical and rheological properties to a crude oil. For example, Alaskan North Slope (ANS) crude oil can be approximated very closely using the present invention. The simulant fluid can be used to evaluate oil spill response, containment, and clean-up of equipment during a specified period of time. The simulant fluids of the present invention can be used to conduct oils spill exercises on terrestrial, freshwater, and/or seawater applications. Often such a response exercise can be conducted over 6 to 8 hour test period or a 1-day oil spill exercise.

One aspect of the present invention includes a non-emulsion based simulant fluid to simulate ANS crude oil behavior for terrestrial, freshwater, and seawater applications. The simulant fluid components may include a biodegradable oil, a terpene, and optional components such as photochromic or food dyes, nutrients and microorganisms, anti-oxidants, and the like. Generally, it is anticipated that the simulant fluid can be used to simulate crude oil-spill behavior for a test period of 8-hours or more at ambient conditions. In an exemplary oil simulant, the property ranges for viscosity, specific gravity, refractive index, pour point, and surface and interfacial tension values of the simulant fluid are sufficiently similar to a typical ANS crude oil to make valuable evaluations of oil spill responses.

In accordance with a detailed aspect of the invention, the non-emulsion simulant fluid can be used on terrestrial, freshwater, and seawater applications to determine the rates of spreading, dispersion, and percolation. In an addition detailed aspect of the present invention, the non-emulsion simulant fluid can be used to test, train, and evaluate oil spill cleanup equipment, personnel, and/or facility, local, state, and national contingency plans in real-time.

In still another aspect of the present invention, the non-emulsion simulant fluid can be used as an environmentally-friendly "green" lubrication fluid such as hydraulic oil. The simulant fluid can be used in gearboxes in lieu of more toxic and less biodegradable petroleum-based fluids.

The non-emulsion-based simulant fluids of the present invention can be a composite fluid with properties similar to crude oil. The properties of the simulant fluid can be easily adjusted and tailored to specific applications via additives and/or adjusting the relative contents of constituent components such as terpene and biodegradable oil. The non-emulsion simulant fluid may be easily prepared on- or off-site without the need of additional mixing or agitation equipment. Further, the simulant fluid is environmentally benign as it exceeds the EPA guidelines and regulations of a non-toxic and readily biodegradable substance.

Additional features and advantages of the invention will be apparent from the detailed description which follows, taken in conjunction with the accompanying drawings, which together illustrate, by way of example, features of the invention.

DETAILED DESCRIPTION

Figure 1:
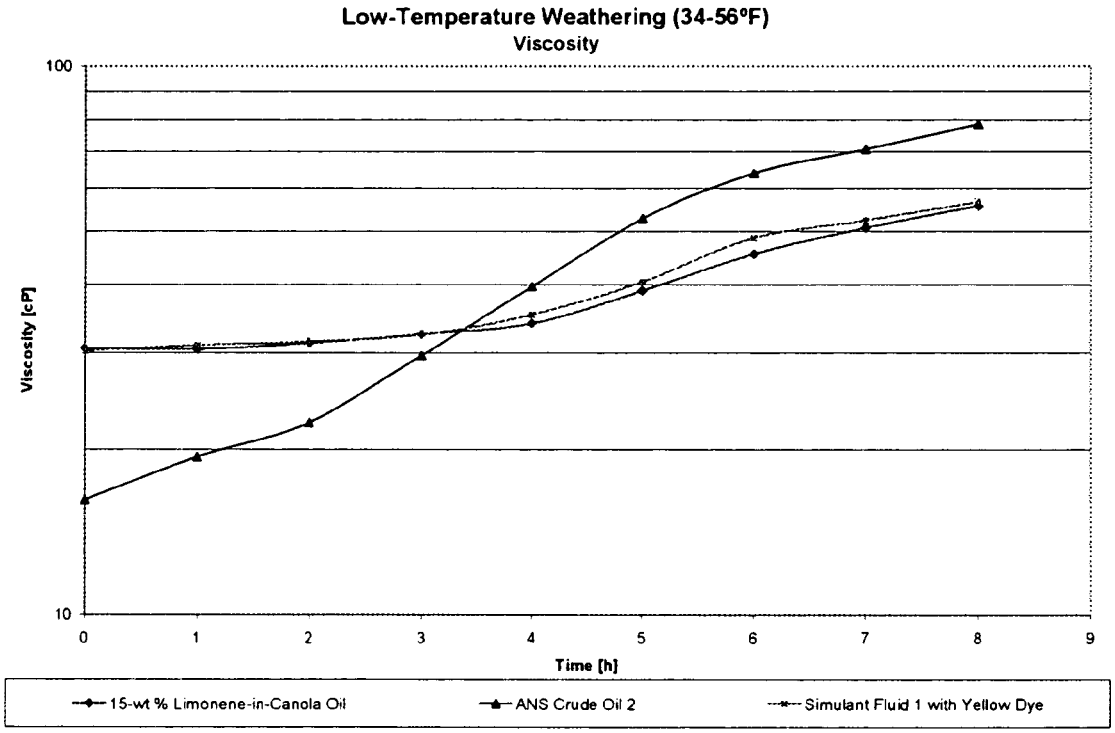
FIG. 1 is a graph showing data of low-temperature weathering of a composition of the invention showing viscosity change over time.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It must be noted that, as used in this specification and the appended claims, the singular forms "a," "an," and "the" include plural referents unless the context clearly dictates otherwise. Thus, for example, reference to "a terpene" includes one or more of such materials, reference to "a biodegradable oil" includes reference to one or more of such oils, and reference to "a mixing step" includes reference to one or more of such steps.

Definitions

In describing and claiming the present invention, the following terminology will be used in accordance with the definitions set forth below.

As used herein, a "readily biodegradable" substance can breakdown and yield 60% of the theoretical maximum carbon dioxide ($CO_2$) and show a removal of 70% dissolved organic carbon (DOC) within 28 days "which lead to the reasonable assumption that the substance will undergo rapid and ultimate biodegradation in aerobic aquatic environments." See 40 CFR §796, which is incorporated herein by reference and specifically §796.3100. According to the EPA guideline, as found in this section of the CFR, ultimate biodegradation is the breakdown of an organic compound to $CO_2$, water, the oxides or mineral salts of other elements and/or to products associated with normal metabolic processes of microorganisms.

As used herein, "terpenes" refers to a class of chemical compounds which include isoprene, $CH_2{=}C(CH_3){-}CH{=}CH_2$, as a fundamental unit. Terpenes can include, but are not limited to, monoterpenes, diterpenes, sesquiterpenes, triterpenes, tetraterpenes, and the like. Further, terpenes are most often isolated from naturally occurring sources; however, synthetic terpenes are also considered within the scope of the present invention.

As used herein, "photochromic" refers to a material which changes color or hue upon exposure to light or ultraviolet radiation. The change in color can be reversible or irreversible. Further, photochromic dyes useful in the present invention are preferably biodegradable.

As used herein with respect to an identified property or circumstance, "substantially" refers to a degree of deviation that is sufficient so as to not measurably detract from the identified property or circumstance. The exact degree of deviation allowable may in some cases depend on the specific context. Thus, for example, "substantially all" of a material leaves either no or only trace amounts of the material. Most often, one or more elements will be completely absent from the composition of interest, rather than a mere change in compositional percentages. Similarly, a "substantially similar" property is one that can be used to effectively approximate behavior of a material sufficient to assess the relevant effect of that property, e.g., rate of percolation or tendency of oil phases to fragment or disperse.

As used herein, a plurality of items, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As a non-limiting example of this principle, although monoterpenes and tetraterpenes are listed as terpenes each class of compounds has unique properties which may make it more or less suitable in a given oil simulant, e.g. monoterpenes have shown exceptional results in approximating ANS crude oil behavior. It is not the purpose of this specification to exhaustively outline every possible distinction among potentially useful components, but rather to illustrate the principles of the present invention, often with the use of such lists.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 10 to about 50" should be interpreted to include not only the explicitly recited values of about 10 to about 50, but also include individual values and sub-ranges within the indicated range. Thus, included in this numerical range are individual values such as 20, 30, and 40 and sub-ranges such as from 10-30, from 20-40, and from 30-50, etc. This same principle applies to ranges reciting only one numerical value. Furthermore, such an interpretation should apply regardless of the breadth of the range or the characteristics being described.

Invention

In accordance with the present invention non-emulsion based oil simulants can be formed which are biodegradable. Further, these oil simulant compositions can be tailored to approximate a specific target oil composition. In this way, accurate, cost effective, and environmentally friendly simulations of accidental oil spills can be performed to improve response readiness and decrease potential damage during an actual spill.

Non-Emulsion Oil Simulant Compositions

In one aspect of the present invention, a non-emulsion simulant fluid can include a biodegradable oil and a terpene. Specific simulant compositions can vary according to the type of simulant application. However, the following description is exemplary of several embodiments of the principles of the present invention.

A variety of biodegradable oils can be used as the basestock fluid. In one embodiment, the biodegradable oil can be a plant derived oil. For example, suitable biodegradable oils can include, but are not limited to, vegetable oil, cottonseed oil, canola oil, palm oil, soybean oil, safflower oil, sunflower oil, corn oil, olive oil, linseed oil, and combinations thereof. The choice of biodegradable oil as a feedstock base can depend somewhat on the type of oil for which is targeted for simulation. For example, vegetable oils can be used as the basestock fluid because they often have substantially similar relevant properties to an ANS crude oil. The content of biodegradable oil can vary depending on the desired properties. However, typical biodegradable oil content can be from about 60 wt % to about 95 wt %, and most often from about 70 wt % to about 90 wt %.

Canola oil is the currently preferred basestock oil, although cottonseed oil and soybean oil can also be used effectively. However, as a general guideline, the canola oil concentration can vary from about 70 wt % to 90 wt %, or preferably 74.9 wt % to 84.9 wt %. The currently preferred amount of canola oil is about 84.9 wt % for applications in 20-60° F. ambient conditions. Notably, for applications at 40-90° F. Canola oil exceeds the Environmental Protection Agency (EPA) regulations for a readily biodegradable substance. Canola oil has been found to biodegrade to greater than 80% within 28 days. Canola oil is also non-toxic such that the lethal dose producing mortality in 50% of the test subjects ($LD_{50}$) via acute oral toxicity is sufficiently high that it is not determined.

The non-emulsion oil simulants of the present invention can also include a terpene. Terpenes have shown to impart desirable properties which more closely approximate crude oils of interest. A wide variety of terpenes can potentially be used in connection with the present invention. For example, suitable sub-classes of terpenes can include monoterpenes, sesquiterpenes, diterpenes, triterpenes, tetraterpenes, or the like. Typically, terpenes include hydrocarbons having substantially only carbon and hydrogen; however, terpenes can also include terpenoids which include oxygen such as alcohols, aldehydes, and ketones. Non-limiting examples of monoterpenes include pinene, nerol, citral, camphor, menthol, and limonene. Non-limiting examples of sesquiterpenes include nerolidol and farnesol; diterpenes include phytol and vitamin Al; triterpene such as squalene; and carotene (provitamin Al) is a tetraterpene. Although the specific compositions can depend on the target oil being simulated, terpenes can typically comprise from about 5 wt % to about 30 wt % of the non-emulsion oil simulant.

In one specific aspect of the present invention, a monocyclic hydrocarbon terpene can be included as a simulant fluid additive. The terpene can act as a property modifier when added to canola oil. The currently preferred terpene is d-limonene and the preferred amount of d-limonene is about 15.0 wt %, although amounts outside this value can also be useful. For example, 10 wt % to about 20 wt % d-limonene can be useful in obtaining good approximation of various crude oils under different temperature conditions. Limonene is a naturally-occurring oil, derived or pressed from citrus peels. The biodegradation rate for d-limonene is on the order of days-to-weeks and is only slightly more toxic than food-grade substances. The acute oral $LD_{50}$ toxicity in rats for d-limonene is 4,400 mg limonene/kg rat.

In an additional alternative aspect, the non-emulsion oil simulant of the present invention can include biodegradable dyes such as photochromic and/or food dyes to enhance the detection of the fluid. Food dyes which can be used include commercially-available red and blue food coloring; however, a currently preferred dye is a photochromic dye. Photosol® 5-3 (yellow) and Photosol® 7-106 (wine purple) dyes are ultraviolet sensitive compounds developed and manufactured by PPG, Inc. The amount of dye can vary depending on the desired intensity of color; however, can often range from about 0.05 wt % to about 2 wt %. For example, the currently preferred amount of either the 5-3 or the 7-106 dye is 0.1 wt %. The biodegradation rate of the Photosol® dyes has not been determined; however, the manufacturer claims that the dyes will degrade between 3 and 8 weeks. The degradation rate of biodegradable dyes can be accelerated by exposure to free radicals such as singlet oxygen; oxidizers such as peroxides; acids and high energy ultraviolet, UVB. Further, the photochromic dyes have a slight to very low toxicity of greater than 5,000 mg/kg acute oral rat $LD_{50}$.

An antioxidant or preservative, preferably a commercially available, food-grade antioxidant, can also be added to the simulant fluid formulation to prevent premature degradation and also act as a viscosity modifier. Any number of antioxidants can be used in the present invention. Non-limiting examples of suitable antioxidants can include butylated hydroxytoluene (BHT), butylated hydroxyl anisole (BHA), 4,4-(2,3-dimethyl tetramethylene dipyrochatechol) (NDGA), alpha tocopherol, propyl gallate, tertiary butylhydroquinone (TBHQ), citric acid, ascorbic acid, rosmariquinone, caffeic and ferulic acid derivatives, 1,2,3,4-tetrahydroxybenzene, and combinations thereof. Generally, BHT, BHA, alpha tocopherol, citric acid, and ascorbic acid can be used with particular efficacy. One currently preferred suitable antioxidant is BHT. The content of antioxidant can also vary depending on the intended conditions of use and expected shelf-life, but can typically vary from about 1 wt % to about 8 wt %, and in the case of BHT is preferably about 3.0 wt %. The antioxidant is usually required for simulant fluid applications as a lubricant fluid. In this case, the BHT behaves as a viscosity modifier and stabilizer to prevent premature breakdown and degradation of the oil simulant composition. The biodegradation rate for BHT has not been determined. The acute oral toxicity $LD_{50}$ of BHT in rats is 4,080 mg/kg.

Microorganisms can also be added to the oil simulant composition to enhance biodegradation rates. Any suitable microorganisms can be used which are capable of degrading the oil simulant composition. Although no particular limitation is intended, two preferred types of microorganisms can be useful: Microbe-PLUS™ manufactured by Newtec: Bio-remediation, Sewer and Water Treatment and indigenous bacteria from waste-water treatment plants. The microorganisms of Microbe-PLUS™ are commonly found in soil and water and are, therefore, not foreign to the ordinary natural environment. In addition, neither Microbe-PLUS™ nor the organisms in Microbe-PLUS™ are toxic agents. When Microbe-PLUS™ bacteria are added to a contaminated environment the original toxicity of the environment remains unchanged, but as the Microbe-PLUS™ organisms grow, the original concentration of organic substances in the environment is reduced. Treatment of organic compounds with Microbe-PLUS™ produces substantially only carbon dioxide and water plus. Further, the bacteria in Microbe-PLUS™ are considered to be non-toxic. These products are screened to assure that no adventitious pathogens are present. An alternative to the commercially-available Microbe-PLUS™ is the use of indigenous bacteria cultivated in the waste-water treatment plants near the spill site. The indigenous bacteria in this case are already found in the environment and will also stimulate biodegradation rates. These microorganisms can be added as part of the non-emulsion oil simulant either before or after dispersion or use. In this way the useful life of the oil simulant can be extended somewhat to allow time for testing and evaluation.

A variety of nutrients can be added to oil simulant compositions or mixtures to increase the biodegradation rate; however, the preferred method is to apply the nutrients to the spill site either prior to or following an oil spill exercise. A number of commercially-available nutrients may be used to maintain the microorganisms. The nutrients can be added to the oil simulant as part of the manufacturing process or can be added later along with microorganisms immediately prior to or subsequent to use. Typical nutrient compositions can include a combination of potash, nitrates, and phosphates, although other nutrients can also be suitable. One specific nutrient composition comprises nitrates (urea nitrogen and ammoniacal nitrogen), available phosphate ($P_2O_5$), and soluble potash ($K_2O$) in 30-10-10 NPK, 10-52-10 NPK, and 20-20-20 NPK, respectively. The biodegradation rate and toxicity can vary depending upon the type of nutrient added, although all are types of fertilizers and are designed to be spread on terrestrial sites.

Methods of Preparation

The formulation procedure for the non-emulsion oil simulant fluid can also vary dependant upon the additives used. The most basic oil simulant fluid can be a mixture of canola oil and d-limonene. The limonene is soluble in canola oil; therefore, simple agitation or mixing is sufficient to combine the fluids. Generally, this is also true of most of the alternative biodegradable oils and corresponding terpenes. In some cases, additional agitation can improve mixing and provide a more homogenous product.

Photochromic dyes are also soluble in the limonene mixture and do not require special consideration. However, food dyes are not generally readily soluble in the terpene-canola oil mixture and significant agitation can be required to dissolve the food coloring. This can generally be accomplished using an ultrasonic bath. The food dyes are not 100% soluble even after sonication; therefore, a small amount of the more dense food coloring can exist in the fluid. The amount of food dye needed is in direct proportion to the hue of color desired; a darker shade requires more food coloring. However, as a general guideline, the amount of biodegradable dye can be less than about 3 wt %.

The addition of the antioxidant is similar to that of the limonene or photochromic dyes. For example, BHT will dissolve in the basic simulant mixture of canola oil and limonene and mixtures including either photochromic or food dyes. The dissolution of BHT is much slower than either the photochromic dyes or limonene so sufficient time is required for sufficient dissolution. Alternatively, an ultrasonic bath or another sonicating device may be used to increase the dissolution rate.

The addition of nutrients and/or microorganisms to the simulant fluid can be performed during formation of the oil simulant. However, the currently preferred method is to either pre-treat or post-treat the simulant spill site using the nutrients or microorganisms to increase the biodegradation rate. The advantages to treating the spill site with nutrients and/or microorganisms separate from the simulant fluid formulation include: decreased simulant fluid preparation requirements, stimulation of indigenous microorganisms and bacteria in the soil and/or water, the ability to retreat a spill site following the spill exercise, and increased shelf life of the oil simulant composition.

The non-emulsion-based crude oil simulants of the present invention can have similar property ranges to crude oils. In the example below, the property ranges are similar to two distinct ANS crude oils. The preparation of the simulant fluid generally requires little more than simple mixing; however, a high shear or ultrasonic agitation may be required for some formulations. In one exemplary embodiment of the present invention, the oil simulant fluid can contain all or part of the following: canola oil, a monocyclic hydrocarbon terpene (generally d-limonene), photochromic dye (yellow or wine purple), food dyes (red and blue), food-grade antioxidant (BHT), nutrients (combination of potash, nitrates, and phosphates) and microorganisms (commercially-available bacteria or indigenous bacteria). The composition and properties of the oil simulant fluid can vary depending upon the type of end-use or spill of the simulant fluid. Accelerated biodegradation of the oil simulant fluid can occur at ambient temperatures and degradation is generally accelerated with increasing temperature.

The resulting non-emulsion oil simulant fluid can be applied to ground surfaces, freshwater, or seawater environments. Ground surfaces can be monitored and tested for percolation, flow, and general behavior of the simulated spill. Similarly, large volumes of the simulant fluids of the present invention can be dumped into freshwater or seawater environments to assess spill behavior, test remediation equipment, clean-up response, and/or evaluate potential damage.

EXAMPLES

The following examples illustrate exemplary embodiments of the invention. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what is presently deemed to be practical embodiments of the invention.

Example 1

Canola oil and d-limonene are used in the following non-emulsion oil simulant fluid mixture examples. The recommended oil simulant fluid contains 84.9 wt % canola oil and 15.0 wt % limonene, and 0.1 wt % photochromic dye PHOTOSOL® 7-106 (wine purple). The limonene is added to the canola oil, followed by the dye. Slight agitation via shaking or stirring is typically performed, but is not required. Fluids requiring the addition of BHT are created with the above mixture modified for a 3.0 wt % addition of BHT. In these cases, the composition includes 81.9 wt % canola oil, 15.0 wt % limonene, 0.1 wt % photochromic dye, and 3.0 wt % BHT.

Example 2

An alternate use of the simulant fluid is the development of an environmentally-friendly lubricant fluid. This fluid is a mixture of canola oil (97.0-wt %) and BHT (3.0-wt %) only.

The above non-emulsion simulant fluid formulations are provided in Table 1 below.

TABLE 1

Example Simulant Fluids

| Non-Emulsion Simulant Fluid | Simulant Fluid Component | Composition [wt %] | Practical Simulant Fluid Uses and Applications |
|---|---|---|---|
| 1 | Canola Oil | 84.90 | Terrestrial, freshwater, and seawater applications |
| | d-Limonene | 15.00 | |
| | Photosol ® 7-106 | 0.10 | |
| 2 | Canola Oil | 97.00 | Environmentally-Friendly Lubricating (Green) Fluid |
| | BHT | 3.00 | |

Figure 2:
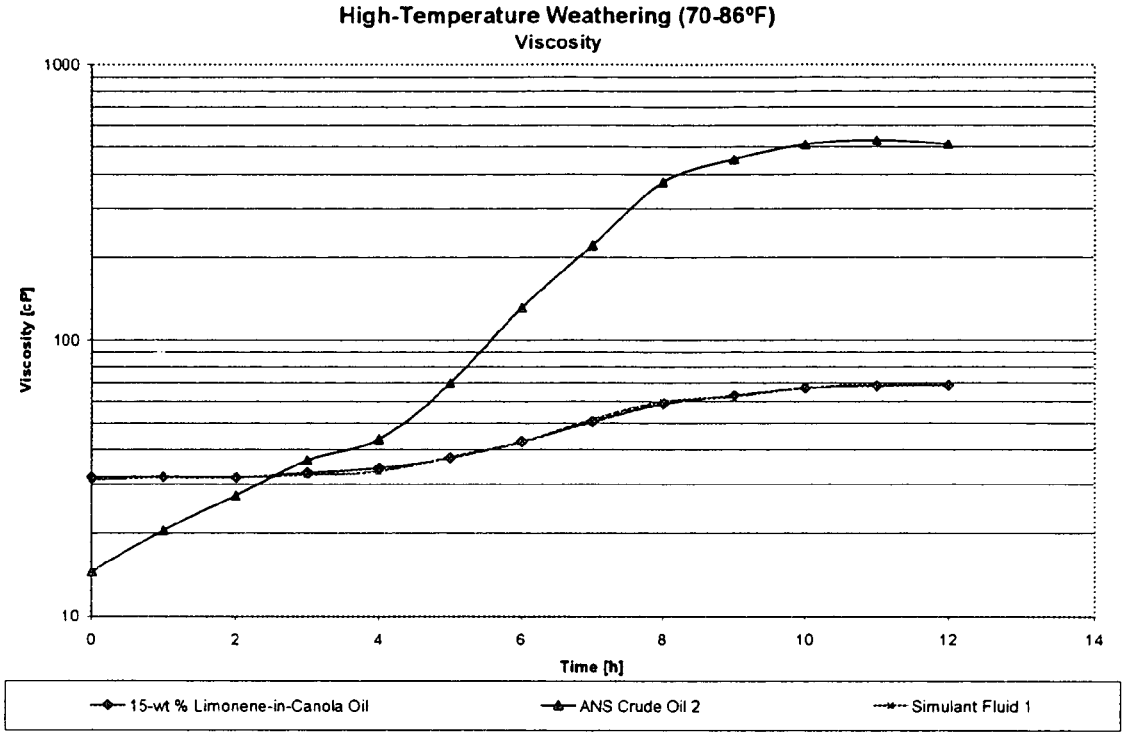
FIG. 2 is a graph showing data of high-temperature weathering of a composition of the invention showing viscosity change over time.

The weathering data illustrated in terms of viscosity for lower and higher temperature tests are given in FIGS. 1 and 2, respectively. FIG. 1 shows low temperature (34-56° F.) weathering tests over an 8 hour period for Simulant Fluid 1 and Simulant Fluid 1 with a yellow dye. The overall trend of increasing viscosity with time is similar. Further, the viscosity of the ANS crude oil is approximated relatively well. It is noted that the correlation is particularly good after the first hour. FIG. 2 illustrates the same fluids tested at higher temperatures, i.e. 70-86° F. Again, the correlation between the simulant fluids and the ANS crude is good. Under most practical conditions correlation at lower temperatures will tend to be more important. However, correlation at higher temperatures can be achieved by reformulating the above oil simulants according to the present invention as described herein.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention. Although some embodiments are shown to include certain features, it is contemplated that any feature disclosed herein may be used together or in combination with any other feature on any embodiment of the invention. It is also contemplated that any feature may be specifically excluded from any embodiment of an invention.

What is claimed is:

1. A non-emulsion oil simulant comprising:

a) a biodegradable oil;

b) a terpene;

c) microorganisms; and d) nutrients for maintaining said microorganisms.

2. The oil simulant of claim 1, wherein the terpene is a member selected from the group consisting of mono-cyclic hydrocarbon terpenes, monoterpenes, sesquiterpenes, diterpenes, triterpenes, tetraterpenes, and combinations thereof.

3. The oil simulant of claim 2, wherein the terpene is a monoterpene.

4. The oil simulant of claim 3, wherein the terpene is d-limonene.

5. The oil simulant of claim 1, wherein the biodegradable oil is selected from the group consisting of vegetable oil, cottonseed oil, canola oil, soybean oil, and mixtures thereof.

6. The oil simulant of claim 1, further comprising at least one biodegradable dye, wherein said biodegradable dye is a photochromic dye or a food dye.

7. The oil simulant of claim 1, further comprising an antioxidant.

8. A non-emulsion crude oil simulant comprising;

a) a biodegradable oil;

b) a terpene;

c) at least one biodegradable dye;

d) a food-grade antioxidant;

e) microorganisms; and f) a sufficient supply of nutrients for maintaining the microorganisms during use of the oil simulant in a simulation environment.

9. The simulant of claim 8, wherein the terpene is d-limonene.

10. The simulant of claim 8, wherein the biodegradable oil is a member selected from the group consisting of canola oil, cottonseed oil, soybean oil, and combinations thereof.

11. The simulant of claim 8, wherein the biodegradable dye comprises a photochromic dye or a food dye.

12. A method for making a non-emulsion crude oil simulant comprising mixing a biodegradable oil, a terpene, microorganisms, and nutrients for maintaining said microorganisms to form a substantially homogeneous liquid composition.

13. The method of claim 12, wherein the terpene is a member selected from the group consisting of mono-cyclic hydrocarbon terpenes, monoterpenes, sesquiterpenes, diterpenes, triterpenes, tetraterpenes, and combinations thereof.

14. The method of claim 13, wherein the terpene is d-limonene.

15. The method of claim 12, wherein the biodegradable oil is selected from the group consisting of vegetable oil, cottonseed oil, canola oil, soybean oil, and mixtures thereof.

16. The method of claim 12, further comprising at least one of a biodegradable dye and an antioxidant.

17. A method of simulating a crude oil spill, comprising:

a) applying a non-emulsion oil simulant to a surface so as to create a simulated crude oil spill, said non-emulsion oil simulant comprising a biodegradable oil and a terpene, said surface being a ground surface, a body of freshwater, or a body of seawater; and b) assessing a property of the simulated crude oil spill.

18. The method of claim 17, wherein the terpene is a member selected from the group consisting of mono-cyclic hydrocarbon terpenes, monoterpenes, sesquiterpenes, diterpenes, triterpenes, tetraterpenes, and combinations thereof.

19. The method of claim 17, wherein the terpene is d-limonene.

20. The method of claim 17, wherein the biodegradable oil is selected from the group consisting of vegetable oil, cottonseed oil, canola oil, soybean oil, and mixtures thereof.

21. The method of claim 17, further comprising at least one biodegradable dye, wherein said biodegradable dye is a photochromic dye or a food dye.

22. The method of claim 17, further comprising microorganisms and nutrients for maintaining said microorganisms.

* * * * *